US009322524B1

(12) United States Patent
Lin et al.

(10) Patent No.: US 9,322,524 B1
(45) Date of Patent: Apr. 26, 2016

(54) ELECTRIC CANDLE

(71) Applicants: Mao-Lung Lin, New Taipei (TW); Zhao-Hui Wen, Zhongba Town (CN); Lu-Kan Wang, Taipei (TW)

(72) Inventors: Mao-Lung Lin, New Taipei (TW); Zhao-Hui Wen, Zhongba Town (CN); Lu-Kan Wang, Taipei (TW)

( * ) Notice: Subject to any disclaimer, the term of this patent is extended or adjusted under 35 U.S.C. 154(b) by 0 days.

(21) Appl. No.: 14/607,598

(22) Filed: Jan. 28, 2015

(51) Int. Cl.

| | |
|---|---|
| ***F21L 4/00*** | (2006.01) |
| ***F21S 10/04*** | (2006.01) |
| ***F21S 6/00*** | (2006.01) |
| ***F21S 10/06*** | (2006.01) |
| ***F21V 23/00*** | (2015.01) |
| ***F21S 9/02*** | (2006.01) |
| *F21Y 101/02* | (2006.01) |
| *F21W 121/00* | (2006.01) |

(52) U.S. Cl.
CPC ..... *F21S 10/046* (2013.01); *F21S 6/001* (2013.01); *F21S 9/02* (2013.01); *F21S 10/06* (2013.01); *F21V 23/003* (2013.01); *F21W 2121/00* (2013.01); *F21Y 2101/02* (2013.01)

(58) Field of Classification Search
CPC ..... F21S 10/046; F21S 6/001; F21S 10/06; F21S 9/02; F21V 23/003; F21Y 2101/02; F21W 2121/00
USPC ..... 362/190, 322, 401, 427
See application file for complete search history.

(56) References Cited

U.S. PATENT DOCUMENTS

| | | | | |
|---|---|---|---|---|
| 2013/0050985 | A1* | 2/2013 | Kwok | F21S 6/001 362/96 |
| 2014/0218903 | A1* | 8/2014 | Sheng | F21S 10/04 362/190 |
| 2015/0036348 | A1* | 2/2015 | Dong | F21S 10/046 362/293 |
| 2016/0040844 | A1* | 2/2016 | Patton | F21S 6/001 362/362 |

* cited by examiner

*Primary Examiner* — Elmito Breval
*Assistant Examiner* — Glenn Zimmerman
(74) *Attorney, Agent, or Firm* — Juan Carlos A Marquez; Bacon & Thomas PLLC

(57) ABSTRACT

An electronic candle includes a casing, a wick assembly, and a light source module. The casing has a top provided with an opening, the opening has an end internally provided with a support, and the support is provided with an aperture. The wick assembly includes a wick element having a wick plate and a counterweight element having a counterweight block. The wick plate has an end provided with a first connecting rod. The counterweight block has an end provided with a second connecting rod. The first connecting rod extends through the aperture and is connected with the second connecting rod in order for the wick assembly to swing freely while supported by the support. The light source module is provided in an interior of an opposite end of the opening and which is composed of at least three LEDs so arranged as to project light to the wick plate.

9 Claims, 6 Drawing Sheets

ELECTRIC CANDLE

BACKGROUND OF THE INVENTION

1. Technical Field

The present invention relates to an electronic candle and more particularly to an electronic candle capable of simulating the swinging of a wick.

2. Description of Related Art

Electronic candles—which are safe and convenient to use, energy-saving, and environmentally friendly—have become more and more popular since their invention, especially in Europe and America, and are gradually replacing the conventional cylindrical candles.

However, the existing electronic candles, though equipped with an electronic control circuit, are limited in function and unable to simulate the movement of a wick precisely. While some electronic candles have a timer function and can show color light, they lack a human touch in design and are disadvantaged by high power consumption, not to mention the poor wick simulation effect. All of the above have restricted the application of electronic candles.

BRIEF SUMMARY OF THE INVENTION

The present invention provides an electronic candle featuring structural simplicity, ease of use, and effectiveness in mimicking the swinging of a wick.

The present invention provides an electronic candle, which includes a casing, a wick assembly, and a light source module. The casing has a top provided with an opening, wherein the opening has an end internally provided with a support, and the support is provided with an aperture. The wick assembly includes a wick element and a counterweight element, wherein the wick element has a wick plate, the wick plate has an end provided with a first connecting rod, the counterweight element has a counterweight block, the counterweight block has an end provided with a second connecting rod, and the first connecting rod extends through the aperture and is connected with the second connecting rod in order for the wick assembly to swing freely while supported by the support. The light source module is provided in an interior of an opposite end of the opening, wherein the light source module is composed of at least three light-emitting diodes (LEDs) so arranged as to project light to the wick plate.

The electronic candle of the present invention uses a controller to control the light-emitting state of light-emitting diodes (LEDs) so that the flashing light of the LEDs is projected to a wick plate, thus enabling the wick plate to better simulate a freely swinging flame.

The detailed features and advantages of the present invention will be described in detail with reference to the preferred embodiments so as to enable persons skilled in the art to gain insight into the technical disclosure of the present invention, implement the present invention accordingly, and readily understand the objectives and advantages of the present invention by perusal of the contents disclosed in the specification, the claims, and the accompanying drawings.

DETAILED DESCRIPTION OF THE INVENTION

Figure 1:
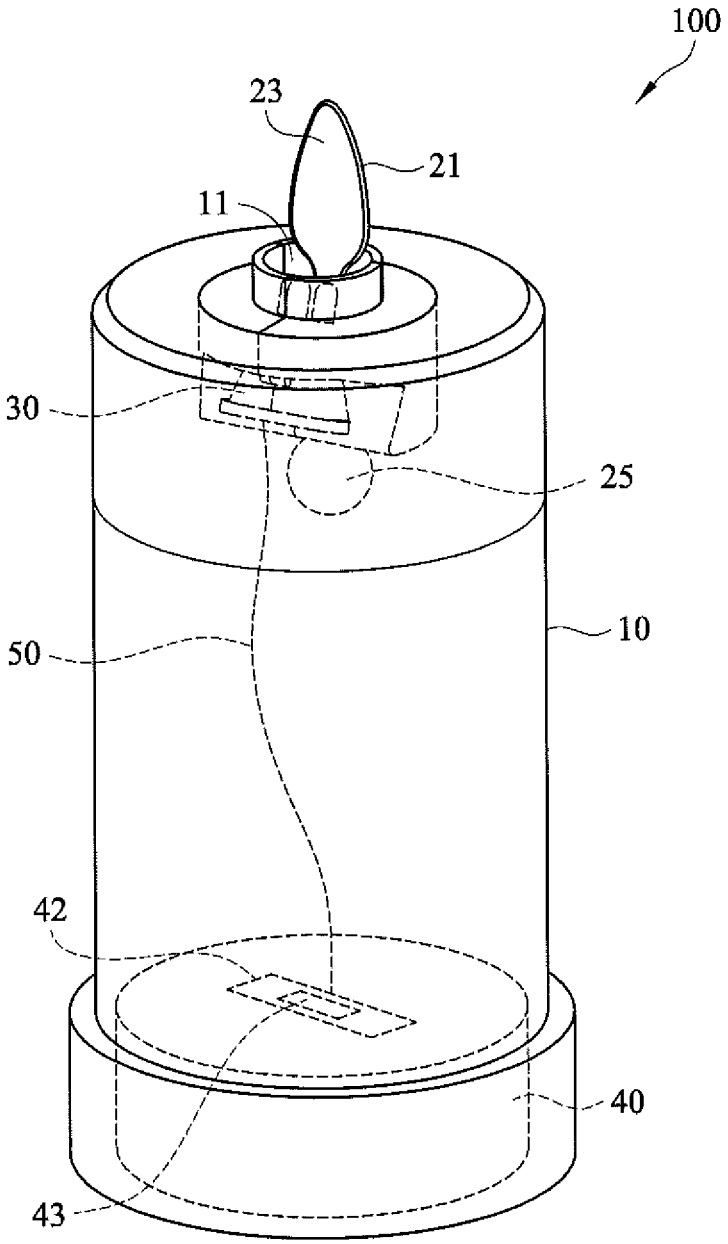
FIG. 1 is a perspective view of the electronic candle in an embodiment of the present invention.
Figure 2:
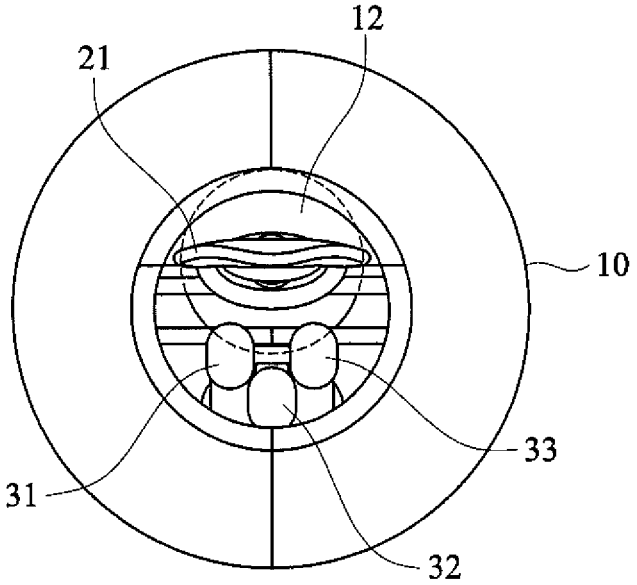
FIG. 2 is a top view of the electronic candle in FIG. 1.
Figure 3:
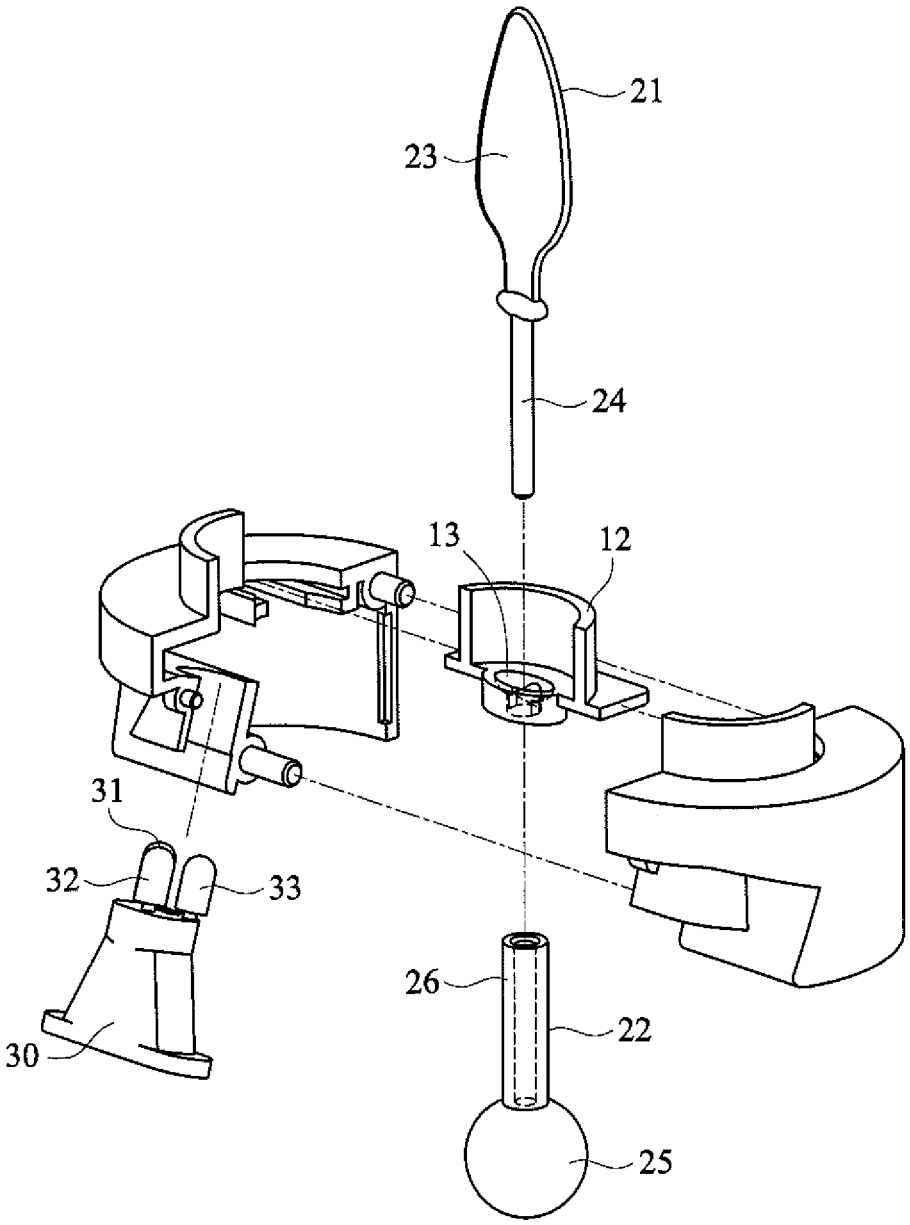
FIG. 3 is a partial exploded view of the electronic candle in FIG. 1.
Figure 4:
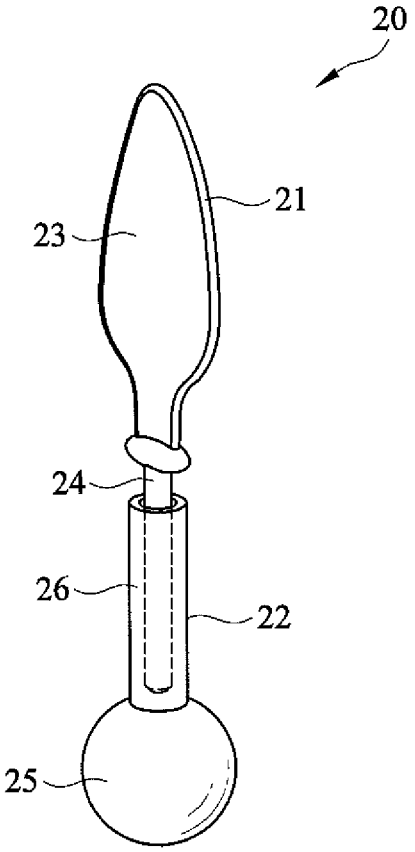
FIG. 4 is a perspective view of the wick assembly used in the electronic candle in FIG. 1.

Please refer to FIG. 1 to FIG. 4 respectively for a perspective view, a top view, and a partial exploded view of the electronic candle in an embodiment of the present invention and a perspective view of the wick assembly used therein.

The electronic candle 100 in this embodiment includes a casing 10, a wick assembly 20, and a light source module 30.

The casing 10 is a hollow housing and is made of plastic for example. The top of the casing 10 has an opening 11 for receiving the wick assembly 20, wherein the opening 11 has one end internally provided with a support 12 for supporting the wick assembly 20. To enable convenient and effective connection between the support 12 and the wick assembly 20 supported thereby, the support 12 is provided with an aperture 13.

The wick assembly 20 includes a wick element 21 and a counterweight element 22. The wick element 21 has a wick plate 23 shaped according to a real flame, with a first connecting rod 24 provided at one end of the wick plate 23. The counterweight element 22 has a counterweight block 25, and one end of the counterweight block 25 is provided with a second connecting rod 26. The first connecting rod 24 extends through the aperture 13 and is connected with the second connecting rod 26 so that the wick assembly 20 can swing freely while supported by the support 12.

The light source module 30 is provided in the interior of the other end of the opening 11 and is composed of three LEDs 31, 32, 33 arranged in such a way that the light emitted by the light source module 30 is projected to the wick plate 23. In this embodiment, the LEDs 31, 32, and 33 are arranged in a triangle so as to project light to the wick plate 23.

Figure 5:
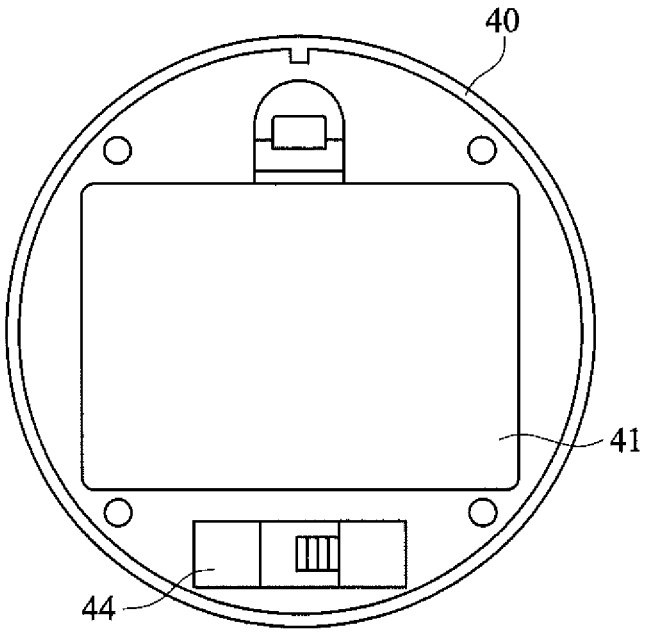
FIG. 5 is a bottom view of the electronic candle in FIG. 1.

Reference is now made to FIG. 1 and FIG. 5, FIG. 5 is a bottom view of the electronic candle 100 in FIG. 1. The electronic candle 100 further includes a base 40 provided at a lower end of the casing 10. The electronic candle 100 also includes a power supply 41 and a driving circuit 42, both provided in the casing 10. The power supply 41 is preferably provided in a lower portion of the base 40 and is electrically connected to the driving circuit 42 so as to supply power to the driving circuit 42.

The driving circuit 42 also can be provided in an upper portion of the base 40 and is electrically connected to the light source module 30 through a wire 50 in order to drive the LEDs 31, 32, and 33 into a flashing state. The driving circuit 42 further includes a controller 43, which is provided on the driving circuit 42 and configured to execute a flashing program and thereby instruct the LEDs 31, 32, and 33 to flash at different frequencies respectively, with a view to better simulating the free swinging motion of a flame visually.

The controller 43 used in this embodiment is of the model number GDSG-2Al2V-I by way of example. In addition, the electronic candle 100 includes a switch 44 provided in a lower portion of the base 40 and electrically connected to the power supply 41 so as to turn on and off the power supply 41.

Figure 6:
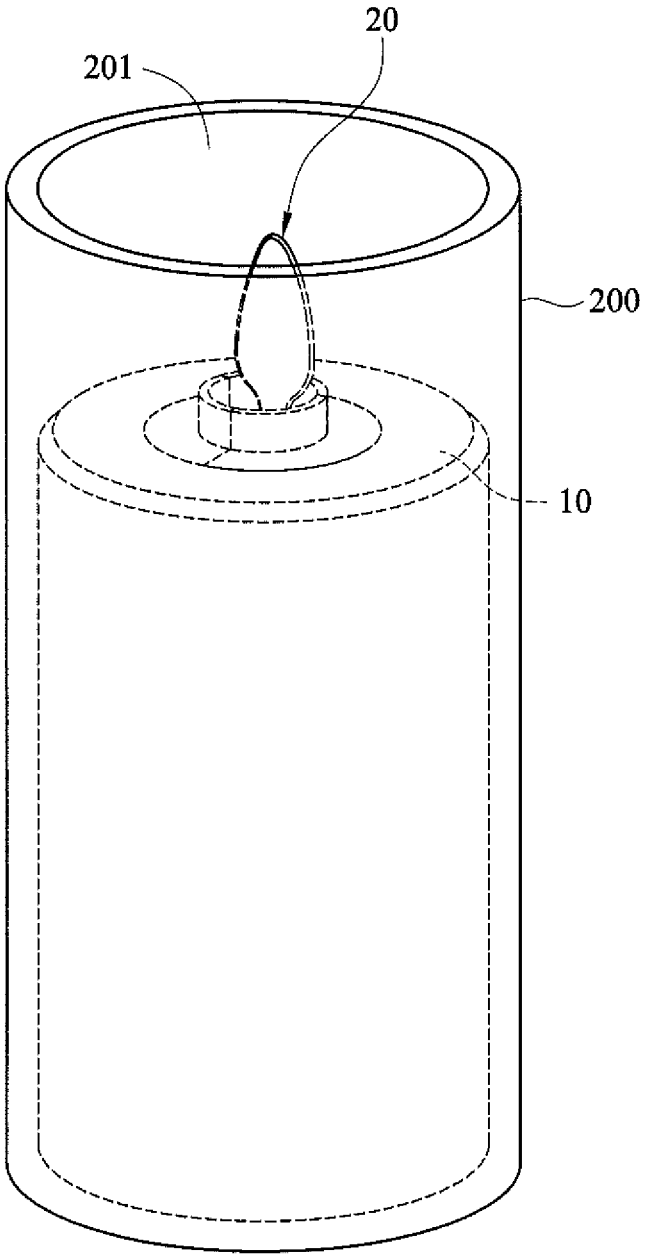
FIG. 6 shows an application of the electronic candle in FIG. 1.

FIG. 6 shows how the electronic candle in the foregoing embodiment can be used. In order for the electronic candle 100 to resemble a conventional candle in appearance, the electronic candle 100 further includes a candle housing 200. The candle housing 200 has a hollow space 201 for receiving the casing 10 and mimicking the look of a conventional candle. The candle housing 200 can be made of clear glass, paraffin, plastic, or resin.

The features of the present invention are disclosed above by the preferred embodiment to allow persons skilled in the art to gain insight into the contents of the present invention and implement the present invention accordingly. The preferred embodiment of the present invention should not be interpreted as restrictive of the scope of the present invention. Hence, all equivalent modifications or amendments made to the aforesaid embodiment should fall within the scope of the appended claims.

What is claimed is:

1. An electronic candle, comprising:

a casing having a top provided with an opening, wherein the opening has an end internally provided with a support, and the support is provided with an aperture;

a wick assembly comprising a wick element and a counterweight element, wherein the wick element has a wick plate, the wick plate has an end provided with a first connecting rod, the counterweight element has a counterweight block, the counterweight block has an end provided with a second connecting rod, and the first connecting rod extends through the aperture and is connected with the second connecting rod in order for the wick assembly to swing freely while supported by the support; and a light source module provided in an interior of an opposite end of the opening, wherein the light source module is composed of at least three light-emitting diodes (LEDs) so arranged as to project light to the wick plate.

2. The electronic candle of claim 1, further comprising a candle housing, wherein the candle housing has a hollow space for receiving the casing.

3. The electronic candle of claim 1, wherein the casing is made of plastic.

4. The electronic candle of claim 1, further comprising a base provided at a lower end of the casing.

5. The electronic candle of claim 1, further comprising a driving circuit provided in the casing and electrically connected to the light source module.

6. The electronic candle of claim 2, wherein the candle housing is made of clear glass, paraffin, plastic, or resin.

7. The electronic candle of claim 5, further comprising a power supply electrically connected to the driving circuit.

8. The electronic candle of claim 5, wherein the driving circuit further comprises a controller for executing a flashing program and thereby controlling a flashing behavior of the at least three LEDs.

9. The electronic candle of claim 7, further comprising a switch electrically connected to the power supply in order to turn on and off the power supply.

* * * * *